METHOD OF TREATING VEHICLE EXHAUST GAS AND CATALYST USED THEREIN

BACKGROUND OF THE INVENTION

Noble metal catalysts extended on carriers, such as $Al_2O_3$-$SiO_2$ carriers coated with Pt or Pt/Rh have been disclosed as useful for the removal of polutants present in truck motor exhaust gases, such as carbon monoxide (CO), nitrogen oxide ($NO_x$), and hydrocarbons. Such catalysts maintain the requisite activity for about 880 hours which corresponds to about 40,000 km, provided the motors are driven with lead-free and halogen-free fuel. When using such noble metal catalysts, the ease of poisoning by lead and halides creates a problem. In addition, the noble metals are costly and scarce.

Several transition metal oxides, for example, $Cr_2O_3$ and $Fe_2O_3$ in the form of chromites and ferrites, and mixtures of $Fe_2O_3$ and $Cr_2O_3$, are known to catalyze the reaction (1)

$$Co + NO \rightarrow CO_2 + \tfrac{1}{2} N_2 \quad (1)$$

which eliminates CO and $NO_x$ from motor vehicle exhaust gases, e.g., from motor truck exhaust gases.

No catalysts with adequate activity and service life are known which will catalyze the aforedescribed reaction (1) and simultaneously catalyze the oxidation of hydrocarbons illustrated in the following reaction (2)

$$C_3H_8 + 5O_2 \rightarrow 3CO_2 + 4H_2O \quad (2)$$

with the exception of those containing some noble metal content, for example, the embedded catalysts. By "adequate activity" is meant a reduction of the CO content to 0.3% by volume; $NO_x$ content to 250 ppm; and hydrocarbon content to 50 ppm.

It is an object of the invention to provide a catalyst having an $Fe_2O_3$-$Cr_2O_3$ base that has an adequate activity and service life which is particularly useful for scavenging truck engine exhaust gases.

SUMMARY OF THE INVENTION

The present invention provides an improved catalyst for treating the exhaust gases from motor vehicles, particularly trucks, to remove therefrom at least part of the CO, $NO_x$, and hydrocarbons. The catalyst contains $Fe_2O_3$ and $Cr_2O_3$ in the form of a solid solution, which solid solution also contains $Fe_3O_4$. The $Fe_3O_4$ is preferably in an amount between about 20 and 50 mol percent based on the total iron oxide content of the catalyst. The minimum amount of $Fe_3O_4$ is that amount such that the resulting catalyst has "adequate activity" as defined hereinbefore.

The catalyst preferably also has a $Fe_2O_3$:$Cr_2O_3$ ratio between about 15:1 and 0.3:1, preferably between about 1:1 and 0.7:1.

The catalyst may also contain iron and/or chromium powder of a very small particle size (grain diameter < 100 μm), preferably in an amount of from about 1% to 15% by volume of the iron and/or chromium powder based on the total amount of $Fe_2O_3$-$Cr_2O_3$. The addition of the iron and/or chromium powder only increases the mechanical stability of the catalysts after sintering, which is particularly important when the catalyst is not supported on a carrier or other substrate, but is used in the form of full contact pellets or the like.

It is particularly advantageous for the catalyst to also contain barium oxide which has the effect of improving the rate of oxidation of the hydrocarbons. The amount of barium oxide is between about 1% and 15 mol percent, based on the total oxides in the catalyst. Similarly potassium oxide and/or lithium oxide may be used together with or in place of the barium oxide, in the same range of percentages.

In a preferred embodiment of the invention, the catalyst is embedded in or otherwise extended on or supported by a carrier (preferably a porous carrier) such as aluminum oxide and/or aluminum silicate.

The invention also provides an improved treatment of exhaust gases from vehicle engines, particularly truck engines, to reduce the amount of CO, $NO_x$, and hydrocarbons to not more than about 0.3% by volume of the CO content, and $NO_x$ content of not more than about 250 ppm (parts per million), and a hydrocarbon content of not more than about 50 ppm. The process is carried out by placing the catalyst in a container such as a "catalytic converter" which is placed in the exhaust system of the motor vehicle, e.g. a truck. The exhaust gases are passed over the catalyst, for example as disclosed in U.S. Pat. No. 3,656,915.

The catalyst in the form of the mixture of oxides and solid solution may be prepared by the methods which are well-known in the art, such as the wet precipitation method illustrated in the Examples. The $Fe_3O_4$ may be formed by partial reduction of the $Fe_2O_3$ component of an admixture therewith $Cr_2O_3$ by contact with hydrogen at a temperature between about 100° C. and 1,000° C. This produces an improved initial catalytic activity and improves the service life of the catalyst.

The invention is further illustrated with reference to the following Examples:

EXAMPLE 1

259 grams of $Fe(NO_3)_3.9\ H_2O$ and 257 grams of $Cr(NO_3)_3.9\ H_2O$ were dissolved in 5 liters of water and at 80° C. the hydroxide was precipitated with ammonia. The precipitate was then recovered by filtering and the filtration residue was twice rinsed with water and dried at about 300° C. The solid dry product was then sintered at 900° C. for 1 hour. It was then stirred into a paste with water and polyvinyl alcohol and pressed in a tablet press to form pills of 4 mm diameter and 2 mm thickness. The pills were then dried for 2 hours at 110° C. and then sintered for two hours at 1150° C. The product consists essentially of a solid solution of $Fe_2O_3$ and $Cr_2O_3$ and with only a small content of $Fe_3O_4$ components which is produced by the weak reduction of some $Fe_2O_3$ during sintering in air by the carbon or carbon monoxide from the polyvinyl alcohol. This catalyst, produced for comparison purposes, corresponds to the prior art.

EXAMPLE 2

The pills obtained following the procedures of Example 1 to the pill-pressing stage, were reduced in an argon-hydrogen stream (10% $H_2$) at 900° C. and a product obtained in which about 50% of the iron is present as $Fe_3O_4$. Such a product is obtained with that reducing agent at that temperature when the reduction treatment lasts between one and two hours.

EXAMPLE 3

The procedure of Example 1 is carried out down through the stage of drying at 300° C., and than a two-hour presintering at 1100° C. was carried out. The dry

SODIUM METASILICATE AS COLD-END ADDITIVE

This application is a continuation-in-part of application Ser. No. 713,747 filed Aug. 12, 1976 now abandoned.

DISCLOSURE OF THE INVENTION

As is well-known to boiler operators, sulfur-containing fuels present problems not only from a pollutional point of view, i.e., acid smut, but also with respect to the life and operability of metallic equipment and parts which are in contact with the flue gases containing the sulfur by-products of combustion.

Upon combustion, the sulfur in the fuel is converted to sulfur dioxide and sulfur trioxide. When sulfur trioxide reaches its dew temperature, it reacts with moisture in the flue gas to produce the very corrosive sulfuric acid. The gases themselves are troublesome as air pollutants, while the acid formed is damaging from corrosion aspects.

As can be appreciated, the greater the sulfur content of the fuel, the more the effects are harmful. This is particularly the case in industrial and utility operations where low grade oils are used for combustion purposes.

Although many additives have been utilized for the purpose of conditioning flue gases, few additives have found overall success. The reason for the relatively little success in this area is felt to be the peculiarities found in the different combustion systems and boiler designs. The gas dynamics and the loads produced, sometimes make chemical treatments for the most part impractical, therefore, requiring a combination of mechanical and chemical treatment.

The basic area to which the present invention is directed is often referred to in the industry as the "cold-end" of a boiler operation. This area is generalized as being the path in the boiler system that the combustion gases follow after the gases have, in fact, performed their service of heating water, producing steam and/or superheating steam.

In the larger boiler systems, the last stages through which the hot combustion gases flow include the economizer, the air heater, the collection equipment or the electrostatic precipitator, and then the stack through which the gases are discharged.

The present invention is drawn to the present inventor's discovery of sodium metasilicate as a cold-end additive.

It was determined that if sodium metasilicate, preferably in liquid droplet form, is fed to the moving combustion gases upstream of the cold-end surfaces to be treated and, preferably, at a point where the gases are undergoing turbulence the chemical will travel along with the gases and deposit on the downstream cold-end surfaces. The liquid droplet form of the additive is accomplished by making an aqueous solution thereof. When fed as liquid droplets the additive travels along with the combustion gases as fine solids and/or liquid droplets and deposits on the downstream cold-end surfaces. The additive could also be fed in particulate form (as dry powder), for example, as disclosed in U.S. Pat. No. 3,932,588. The deposition of the additive on the cold-end surfaces results from the transition of the gas flow from a zone of relative turbulence to a zone where the turbulence subsides or from the impact of additive on the surfaces which interrupt or restrict gas flow.

As already noted, the additive is preferably fed in liquid droplet form to the gases. There are numerous methods available to the artisan for feeding the additive in droplet form, which methods are deemed well within the skill of the art. For example, liquid atomizer nozzles could be utilized for the purpose. The present inventor obtained satisfactory results using a sonic feed nozzle to produce a mist of the additive solution even though additive deposits formed on the nozzle. The use of a pressure atomizing nozzle system with in-line dilution and water purging should resolve any problems related to the formation of deposits on the nozzle. The size range of the liquid droplets is preferably small enough to ensure that the additive will be carried along with the combustion gases so as to be deposited on the surfaces to be treated. Based upon the present inventor's prior experience in this area, the size of the droplets could be as large as about 360 microns with the preferred maximum size being about 260 microns. The same size limitations would apply to particle sizes if the additive is present in particulate form. The amount of the sodium metasilicate added is a function of the sulfur content of the fuel, and more specifically, the $SO_3$ (sulfur trioxide) produced upon combustion. On an actives basis, as little as about 0.15 pound of sodium metasilicate per pound of $SO_3$ generated could be used. The preferred minimum is about 0.25 pound of sodium metasilicate per pound of $SO_3$. Based on economic considerations, the amount of active additive fed could be as high as about 1.0 pound per pound of $SO_3$, while about 0.75 pound of sodium metasilicate per pound of $SO_3$ represents the preferred maximum. Particularly good results were observed at a feed rate of 0.45 pound per pound of $SO_3$.

At the point of adding the additive (point of addition) the combustion gases have a temperature of from about 250° F. to about 1000° F. and preferably from about 350° F. to about 650° F. Since, in most instances, the temperature of the combustion gases will be at least 405° F. at the point of addition, that is the most preferred lower limit of the temperature range.

In order to assess the efficacy of the inventive compound various tests were conducted on industrial boiler systems which were fired by fuel oil containing about 2.2 percent sulfur. The abilities of the inventive additive to coat surfaces and to reduce acid deposition, corrosion and fouling were evaluated. Acid deposition rates at various surface temperatures were determined by titrating washings from a standard air-cooled CERL probe. The nature of the surface coating was determined by visual inspection of the probe. The washings were also analyzed for total iron and total solids content to obtain indications of corrosion rates and fouling tendencies, respectively. Using a Land meter, the rate of acid build-up (RBU) was determined.

The material tested was an aqueous solution containing 25% active sodium metasilicate. While the anhydrous form of sodium metasilicate was used, the hydrated form could also be used. The additive, in liquid form, was fed to the combustion gases in a duct at the cold-end of the systems, using an atomizer nozzle located in the duct.

In a first series of tests, which will hereinafter be referred to as the preliminary tests, the combustion gases contained about 18 parts of sulfur trioxide per million parts of combustion gases on a volume basis.

In a second series of tests, which will hereinafter be referred to as the confirming tests, the combustion gases contained about 55 parts of sulfur trioxide per million confirming tests the probe was exposed for the periods as indicated in Table 3B. The steam loads and active additive are expressed as pounds per hour (pph), the oxygen content of the combustion gases as percent oxygen (%$O_2$) by volume, and the iron content as parts of iron per million parts of washing liquid at the probe temperatures indicated.

TABLE 3A

| Additive | Feedrate (pph) | Steam Load (pph × $10^3$) | % $O_2$ | Iron (ppm) 230° F | 250° F |
|---|---|---|---|---|---|
| None | — | 90 | 2.7 | 16 | 6 |
| $Na_2SiO_3$ | 4.1 | 90 | 2.7 | 8 | 4 |
| $Na_2SiO_3$ | 4.1 | 90 | 2.7 | 8 | 5 |

TABLE 3B

| Additive | Exposure (hours) | Feed-rate (pph) | Steam Load (pph × $10^3$) | % $O_2$ | Iron (ppm) 230° F | 250° F |
|---|---|---|---|---|---|---|
| None | 0.5 | — | 100 | 2.5–3.0 | 70 | 55 |
| None | 0.5 | — | 100 | 2.5–3.0 | 90 | 60 |
| None | 0.5 | — | 100 | 2.5 | 60 | 25 |
| None | 3.0 | — | 104 | 2.5–3.0 | 130 | 70 |
| None | 6.0 | — | 104 | 2.6–3.1 | 400 | 200 |
| $Na_2SiO_3$ | 0.5 | 3.8 | 100 | 2.5–3.0 | 32 | 16 |
| $Na_2SiO_3$ | 3.0 | 3.8 | 104 | 2.5–3.0 | 35 | 35 |
| $Na_2SiO_3$ | 6.0 | 3.8 | 104 | 2.5–3.0 | 80 | 30 |

From the results reported in Tables 3A and 3B, it can be seen that the corrosion was indeed effectively reduced; and these results are seen to indicate the efficacy of the additive in reducing the corrosion of surfaces exposed to combustion gases in the cold-end of a boiler system.

EXAMPLE 4

In addition to analyzing the washings from the CERL probe for iron content, the total solids content of each sample was also determined to evaluate the fouling tendencies of the sodium metasilicate. While it is expected that an additive treatment at the cold-end of a boiler system would cause fouling, the fouling should not be so severe as to outweigh the advantages of the cold-end additive. The results of these tests are reported below in Tables 4A and 4B. In each of the preliminary tests, the results of which are reported in Table 4A, the probe was exposed to the combustion gases for a period of 0.5 hour; while in each of the confirming tests, the results of which are reported in Table 4B, the probe was exposed for a time period as indicated. The total solids are reported as parts of total solids per million parts of washing water at the probe surface temperatures indicated.

TABLE 4A

| Additive | Feed-rate (pph) | Steam Load (pph × $10^3$) | % $O_2$ | Total Solids (ppm) 230° F | 250° F | 300° F |
|---|---|---|---|---|---|---|
| None | — | 90 | 2.7 | 180 | 130 | 70 |
| $Na_2SiO_3$ | 4.1 | 90 | 2.7 | 540 | 520 | 500 |

TABLE 4A-continued

| Additive | Feed-rate (pph) | Steam Load (pph × $10^3$) | % $O_2$ | Total Solids (ppm) 230° F | 250° F | 300° F |
|---|---|---|---|---|---|---|
| $Na_2SiO_3$ | 4.1 | 90 | 2.7 | 600 | 570 | 540 |

TABLE 4B

| Additive | Exposure (hours) | Feedrate (pph) | Steam Load (pph × $10^3$) | % $O_2$ | Total Solids (ppm) 230° F | 250° F | 300° F |
|---|---|---|---|---|---|---|---|
| None | 0.5 | — | 100 | 2.5–3.0 | 570 | 390 | 300 |
| None | 3.0 | — | 104 | 2.5–3.0 | 1800 | 1300 | 150 |
| None | 6.0 | — | 104 | 2.6–3.1 | 3000 | 2000 | 400 |
| $Na_2SiO_3$ | 0.5 | 3.8 | 100 | 2.5–3.0 | 550 | 520 | 425 |
| $Na_2SiO_3$ | 3.0 | 3.8 | 104 | 2.5–3.0 | 2600 | 2500 | 2100 |
| $Na_2SiO_3$ | 6.0 | 3.8 | 104 | 2.5–3.0 | 5200 | 5000 | 4800 |

Based upon the results reported in Tables 4A and 4B, the rate of solids deposition on the surfaces when the additive is used is considered to be acceptable, particularly since the deposits were easily removed.

EXAMPLE 5

In another series of tests, the CERL probe was exposed to the combustion gases for various periods of time, removed and visually inspected. The results are reported below in Table 5. The sodium metasilicate solution was further diluted with one part of water by volume.

TABLE 5

| Additive | Exposure (hours) | Appearance of Probe |
|---|---|---|
| None | 0.5 | Green coating on cold-end of probe. |
| None | 3.0 | Heavy green coating on cold-end. |
| None | 6.0 | Very heavy green coating on cold-end, which coating was difficult to wash off. |
| $Na_2SiO_3$ | 0.5 | Gritty white deposit. |
| $Na_2SiO_3$ | 3.0 | Moderate white deposit on leading and trailing edge. Deposits were easily removed. |
| $Na_2SiO_3$ | 6.0 | Same as 3 hours, but with more deposit. |

Having thus described the invention, what is claimed is:

1. A method of reducing the amount of sulfur trioxide condensation on, and therefore the amount of sulfuric acid corrosion of, metal parts at the cold-end of a combustion system in contact with combustion gases derived from the combustion of sulfur-containing fuel, which combustion gases flow along a path at the cold-end of the combustion system from a first zone of relative turbulence to a second zone at which the turbulence subsides, said method comprising:

adding to the combustion gases at the cold-end of the combustion system and at said zone of turbulence an effective amount for the purpose of an additive consisting essentially of sodium metasilicate such that the additive will travel along with said combustion gases as fine solids or liquid droplets or back from said zone of turbulence to said second zone and will deposit on surfaces of said metal parts, wherein at the point of addition the combustion gases have a temperature of from about 405° F. to about 1000° F.

2. The method of claim 1, wherein the additive is fed in an amount of from about 0.15 to about 1.0 pound of active sodium metasilicate per pound of sulfur trioxide produced upon combustion of the fuel.

3. The method of claim 2, wherein the additive is fed in an amount of from about 0.25 to about 0.75 pound of active sodium metasilicate per pound of sulfur trioxide produced upon combustion of the fuel.

4. The method of claim 1, wherein the additive is an aqueous solution of sodium metasilicate.

5. The method of claim 4, wherein the aqueous solution is fed in droplet form to the combustion gases.

6. The method of claim 5, wherein the additive is fed in an amount of from about 0.15 to about 1.0 pound of active sodium metasilicate per pound of sulfur trioxide produced upon combustion of the fuel.

7. The method of claim 6, wherein the additive is fed in an amount of from about 0.25 to about 0.75 pound of active sodium metasilicate per pound of sulfur trioxide produced upon combustion of the fuel.

8. The method of claim 1, wherein the combustion system is a steam generating system, and wherein the fuel is sulfur-containing oil.

9. The method of claim 8, wherein the additive is fed in an amount of from about 0.15 to about 1.0 pound of active sodium metasilicate per pound of sulfur trioxide produced upon combustion of the fuel.

10. The method of claim 9, wherein the additive is fed in an amount of from about 0.25 to about 0.75 pound of active sodium metasilicate per pound of sulfur trioxide produced upon combustion of the fuel.

11. The method of claim 5, wherein the additive is sprayed into the combustion gases.

12. The method of claim 10, wherein the additive is sprayed into the combustion gases.

13. The method of claim 3, wherein the additive is sprayed as an aqueous solution in droplet form into the combustion gases.

14. The method of claim 13, wherein the droplets have a size of about 360 microns or less.

15. The method of claim 14, wherein the droplets have a size of about 260 microns or less.

16. The method of claim 15, wherein at the point of addition the combustion gases have a temperature of from about 405° F. to about 650° F.

17. The method of claim 1, wherein at the point of addition the combustion gases have a temperature of from about 405° F. to about 650° F.

* * * * *